US009801469B2

(12) United States Patent
Hodge

(10) Patent No.: US 9,801,469 B2
(45) Date of Patent: Oct. 31, 2017

(54) VERSATILE ACCESSORY HOLDER FOR A BARBER CHAIR

(71) Applicant: Morono Hodge, Washington, DC (US)

(72) Inventor: Morono Hodge, Washington, DC (US)

( * ) Notice: Subject to any disclaimer, the term of this patent is extended or adjusted under 35 U.S.C. 154(b) by 139 days.

(21) Appl. No.: 14/702,495

(22) Filed: May 1, 2015

(65) Prior Publication Data

US 2016/0316912 A1 Nov. 3, 2016

(51) Int. Cl.
*A47C 1/11* (2006.01)
*A45D 44/04* (2006.01)

(52) U.S. Cl.
CPC ..... *A47C 1/11* (2013.01); *A45D 44/04* (2013.01)

(58) Field of Classification Search
CPC ..... A45D 44/02; A45D 44/04; A45D 44/06; A45D 44/10; A45D 44/16; A47C 1/04; A47C 1/06; A47C 1/08; A47C 1/10; A47C 1/11
See application file for complete search history.

(56) References Cited

U.S. PATENT DOCUMENTS

| | | | | |
|---|---|---|---|---|
| 1,238,951 A | | 9/1917 | Peckham | |
| 1,332,587 A | | 3/1920 | Yeomans | |
| 1,416,767 A | * | 5/1922 | Vought | A45D 44/04 211/88.01 |
| 2,245,469 A | | 6/1941 | Ecklund et al. | |
| 2,700,993 A | | 2/1955 | Pence | |
| 2,803,292 A | * | 8/1957 | Nyberg | A47C 1/04 108/137 |
| 2,954,077 A | * | 9/1960 | Eugene | A47C 1/04 297/403 |
| 3,028,888 A | | 4/1962 | Chapin et al. | |
| 3,029,509 A | | 4/1962 | Peters | |

(Continued)

FOREIGN PATENT DOCUMENTS

| | | | | |
|---|---|---|---|---|
| CN | 201550792 U | | 8/2010 | |
| CN | 201585578 U | | 9/2010 | |
| CN | 202128017 U | | 2/2012 | |
| CN | 202311815 U | | 7/2012 | |
| FR | 836408 A | * | 1/1939 | A47C 1/08 |
| JP | 2007325889 A | | 12/2007 | |
| KR | 2008076887 A | | 8/2008 | |
| WO | WO03061428 A1 | | 7/2003 | |

OTHER PUBLICATIONS https://www.andis.com/bladegapper, Andis Blade Zero Gapper—2011 Andis Company, printout dated Dec. 10, 2013.
http://www.justrightsharpening.com/bladesetter.html, Blade Setter, Division of , A15-11 for T Outliner & Outliner II . printout dated Dec. 10, 2013.

(Continued)

*Primary Examiner* — Joshua Rodden
(74) *Attorney, Agent, or Firm* — Winston & Strawn LLP

(57) ABSTRACT

The invention relates to a versatile accessory holder for a barber chair and method to attach the versatile accessory holder to the back of one of a plurality of barber chair types. Certain embodiments of the invention have a plurality of slots that may be used to receive an appendage in the form of a tongue or one or more sets of pins to attach the versatile accessory holder to the back of a chair. Certain embodiments of the versatile accessory holder have a tray with compartments to receive accessories, such as clipper blades. In some embodiments, the compartments have an opening at the bottom, and some embodiments have compartment stops to enable hair to fall from a blade resting in the compartment onto the floor. In some embodiments, the outer wall of the tray has a strip adapted to fasten a magnet to the outer wall of the tray.

12 Claims, 12 Drawing Sheets

(56) References Cited

U.S. PATENT DOCUMENTS

| | | | | | |
|---|---|---|---|---|---|
| 3,044,828 | A * | 7/1962 | Fowler | A47C 1/04 | 211/86.01 |
| 3,235,305 | A | 2/1966 | Dlouhy et al. | | |
| 3,245,716 | A * | 4/1966 | Danner | A45D 19/10 | 108/25 |
| 3,894,340 | A | 7/1975 | Ellis, Jr. | | |
| 3,986,649 | A * | 10/1976 | Heimstra | B60R 7/043 | 211/42 |
| 4,007,542 | A | 2/1977 | Bergendorff | | |
| 4,136,908 | A | 1/1979 | Crayne | | |
| 4,368,745 | A | 1/1983 | McGuffey | | |
| 4,499,898 | A | 2/1985 | Knepshield et al. | | |
| 4,517,998 | A | 5/1985 | Furco | | |
| 4,630,378 | A | 12/1986 | Kulp et al. | | |
| 4,700,489 | A | 10/1987 | Vasile | | |
| 4,757,928 | A * | 7/1988 | Browne | B60N 3/103 | 224/275 |
| 4,792,183 | A * | 12/1988 | Townsend, III | B60N 3/004 | 108/27 |
| 4,830,031 | A | 5/1989 | Quinones et al. | | |
| 5,107,869 | A | 4/1992 | Henry | | |
| 5,329,703 | A | 7/1994 | Craig | | |
| 5,370,060 | A * | 12/1994 | Wang | B60N 3/004 | 108/149 |
| 5,817,097 | A | 10/1998 | Howard et al. | | |
| 5,887,940 | A | 3/1999 | Anderson et al. | | |
| 6,170,680 | B1 * | 1/2001 | Hung | A45D 44/02 | 211/119.007 |
| 6,502,900 | B1 * | 1/2003 | Johnston | B60R 7/043 | 108/44 |
| 6,607,241 | B2 * | 8/2003 | Johnston | B60N 2/20 | 297/163 |
| 6,910,429 | B1 * | 6/2005 | Matay | B25H 3/06 | 108/152 |
| 7,171,758 | B2 | 2/2007 | Brueckert et al. | | |
| 7,201,443 | B2 * | 4/2007 | Cilluffo | B60N 2/4876 | 248/917 |
| 7,245,199 | B1 | 7/2007 | Reilly | | |
| 7,281,762 | B1 * | 10/2007 | Getfield | B60N 3/004 | 297/163 |
| 7,290,349 | B1 | 11/2007 | Carpenter | | |
| 7,350,314 | B2 | 4/2008 | McCambridge et al. | | |
| 7,735,237 | B1 | 6/2010 | Moon | | |
| 8,397,963 | B2 * | 3/2013 | Singh | B60N 3/004 | 224/275 |
| 8,479,630 | B2 | 7/2013 | Osbourne | | |
| 8,800,572 | B1 | 8/2014 | Hodge | | |
| 2007/0144025 | A1 | 6/2007 | McCambridge et al. | | |
| 2008/0078418 | A1 | 4/2008 | Ghoorchian | | |
| 2008/0222906 | A1 | 9/2008 | Austin | | |
| 2009/0184077 | A1 * | 7/2009 | Curet | A45D 44/04 | 211/117 |
| 2009/0217937 | A1 | 9/2009 | Nelson | | |
| 2010/0101596 | A1 | 4/2010 | Regalado et al. | | |
| 2011/0067724 | A1 | 3/2011 | Regalado et al. | | |
| 2011/0248531 | A1 * | 10/2011 | Powell | A47C 1/11 | 297/163 |
| 2012/0198716 | A1 | 8/2012 | Tonges et al. | | |
| 2012/0272540 | A1 | 11/2012 | Ornelaz, Jr. | | |
| 2013/0068809 | A1 * | 3/2013 | Wang | B60R 11/02 | 224/275 |

OTHER PUBLICATIONS (This is an audio demo video—not a document), listed as published Nov. 19, 2012, available online at least as early as May 1, 2015 http://www.youtube.com/watch?v=uQD8aBT619c.

(This is an audio demo video—not a document), listed as published Mar. 14, 2011, available online at least as early as May 1, 2015 http://www.youtube.com/watch?v=2ITE8INAoak.

(This is an audio demo video—not a document), listed as published Feb. 18, 2010, available online at least as early as May 1, 2015 http://www.youtube.com/watch?v=ADbINsCMTkc.

U.S. Appl. No. 14/099,631, filed Dec. 6, 2013.

Web Article, Barber Chairs on Pinterest, 6 pages, Available online at least as early as Apr. 29, 2015 https://www.pinterest.com/steve0559/barber-chairs/.

Web Article, Barber Chairs—Google Image Search, 11 pages, Available online at least as early as Apr. 29, 2015 https://www.google.com/search?q=barber+chairs&es_sm=122&source=Inms&tbm=isch&sa=X&ei=2Fk9VeiOFcOyggTAI4GYCQ&ved=0CAgQ_AUoAg&biw=1200&bih=1835#imgrc=_.

Web Article, Elegance Vintage Barber Chairs—Barber Chair—Barber Shop Supplies—Salon Products—Takara Belmont USA, Inc. (Overview), 2 pages, Available online at least as early as Apr. 29, 2015 http://beauty//takarabelmont.com/Salon-Products-for-Professional-Salons/Barber-Shop-Supplies/Barber-Chair/Elegance-Vintage-Barber-Chairs?tab=1

Web Article, Elegance Vintage Barber Chairs—Barber Chair—Barber Shop Supplies—Salon Products—Takara Belmont USA, Inc.Elegance Barber Chair Specs:, 2 pages, Available online at least as early as Apr. 29, 2015 http://beauty.takarabelmont.com/Salon-Products-for-Professional-Salons/Barber-Shop-Supplies/Barber-Chair/Elegance-Vintage-Barber-Chairs?tab=2.

Web Article, Elegance Vintage Barber Chairs—Barber Chair—Barber Shop Supplies—Salon Products—Takara Belmont USA, Inc. (Images), 2 pages, Available online at least as early as Apr. 29, 2015 http://beauty.takarabelmont.com/Salon-Products-for-Professional-Salons/Barber-Shop-Supplies/Barber-Chair/Elegance-Vintage-Barber-Chairs?tab=4.

Web Article, Elegance-Barber-Chair-BB-225, Available online at least as early as Apr. 29, 2015 http://beauty.takarabelmont.com/Salon-Products-for-Professional-Salons/Barber-Shop-Supplies/Barber-Chair/Elegance-Vintage-Barber-Chairs.

Web Article, Barber Chairs & Barber Shop Equipment for Sale, 5 pages, Available online at least as early as Apr. 29, 2015 http://www.agssalonequipment.com/barberchairs.html.

Web Article, Regalo II Barber Chair—Barber Chair—Barber Shop Supplies—Salon Products—Takara Belmont USA, Inc (Overview), 2 pages, Available online at least as early as Apr. 29, 2015 http://beauty.takarabelmont.com/Salon-Products-for-Professional-Salons/Barber-Shop-Supplies/Barber-Chair/Regalo-II-Barber-Chair.

Web Article, Belmont Ventage Barber Chair Headrest_eBay—3 pages, Available online at least as early as Apr. 29, 2015 http://www.ebay.com/itm/BELMONT-Ventage-Barber-Chair-Headrest-/271844777119.

Web Article, Belmont Barber Chair_eBay, Available online at least as early as Apr. 29, 2015 http://www.ebay.com/bhp/belmont-barber-chair.

Web Article, Salon, Barber and Spa Equipment_Takara Belmont—Takara Belmont USA, Inc. 2 pages, Available online at least as early as Apr. 29, 2015 http://beauty.takarabelmont.com/.

Web Article, Regalo II Barber Chair—Barber Chair—Barber Shop Supplies—Salon Products—Takara Belmont USA, Inc (Specs) 2 pages, Available online at least as early as Apr. 29, 2015 http://beauty.takarabelmont.com/Salon-Products-for-Professional-Salons/Barber-Shop-Supplies/Barber-Chair/Regalo-II-Barber-Chair?tab=2.

Web Article, Barber Chair—Barber Shop Supplies—Salon Products—Takara Belmont USA, Inc., 2 pages, Available online at least as early as Apr. 29, 2015 http://beauty.takarabelmont.com/Salon-Products-for-Professional-Salons/Barber-Shop-Supplies/Barber-Chair/.

Web Article, Regalo II Barber Chair—Barber Chair—Barber Shop Supplies—Salon Products—Takara Belmont USA, Inc (Images), 2 pages, Available online at least as early as Apr. 29, 2015 http://beauty.takarabelmont.com/Salon-Products-for-Professional-Salons/Barber-Shop-Supplies/Barber-Chair/Regalo-II-Barber-Chair?tab=4.

Web Article, KOKEN Elegance Barber Chair, 3 pages, Available online at least as early as Apr. 29, 2015 http://www.

(56) References Cited

OTHER PUBLICATIONS americanbeautyequipment.com/Takara%20Belmont%20Koken%20Elegance%20Barber%20Chair.htm.
Web Article, Antique Barber Advertising & Store Collectibles Price Guide Antiques & Collectibles Price Guide Kovels, 28 pages, Available online at least as early as Apr. 29, 2015 http://www.kovels.com/price-guide/advertising-store-collectibles-price-guide/barber.html.
Web Article, Barber Chairs Used—Information About Using Barber Chairs, 16 pages, Available online at least as early as Apr. 29, 2015 http://milwaukee-6916-39.newsabc.biz/.
Web Article, Barber chair—Wikipedia, the free encyclopedia, 3 pages, Last edit listed at Jan. 15, 2015, Available online at least as early as Apr. 29, 2015 http://en.wikipedia.org/wiki/Barber_chair.
Web Article, Barber Chair , Manufacturers from Mingjian Beauty Hairdressing Articles Firm, 3 pages, Marked as copyright 2011, Available online at least as early as Apr. 29, 2015 http://sell.pakuya.com/product-info/42980/barber-chair.html.
Web Article, Barber Chairs, Products for Barber Chairs Manufacturers, Exporters, Suppliers, 3 pages, Marked as copyright 2011, Available online at least as early as Apr. 29, 2015 http://www.pakuya.com/supply-list/5480/Barber-Chairs.html.
Web Article, Oster®, Clipper and Trimmers Blades and Accessories at Osterstyle.com., 3 pages, Available online at least as early as Apr. 29, 2015 http://www.osterstyle.com/blades/clipper-blades/.
Web Article, Oster® Titan® 2 Speed Universal Motor Clipper with Coated Detachable #000 & #1 Blades at Osterstyle.com, 3 pages, Available online at least as early as Apr. 29, 2015 http://www.osterstyle.com/clippers/oster-titan-2-speed-universal-motor-clipper-with-coated-det . . . .
Web Article, Oster® etachable Blade Size 1A Fits Classic 76, Octane, Model One, Model 10, Outlaw Clippers at Osterstyle.com, 3 pages, Available online at least as early as Apr. 29, 2015 http://www.osterstyle.com/blades/clipper-blades/osterdetachable-blade-size-1a-fits-classic-76-o . . . .
Web Article,Oster® Detachable Blade Size 1 Fits Classic 76, Octane, Model One, Model 10, Outlaw Clippers at Osterstyle.com, 3 pages, Available online at least as early as Apr. 29, 2015 http://www.osterstyle.com/blades/clipper-blades/oster-detachable-blade-size-1-fits-classic-76-o . . . .
Web Article, Detachable Blade Size 0000 Fits Classic 76, Octane, Model One, Model 10, Outlaw Clippers at Osterstyle.com, 2 pages, Available online at least as early as Apr. 29, 2015 http://www.osterstyle.com/blades/clipper-blades/oster-detachable-blade-size-0000-fits-classic-7 . . . .
Web Article, Shop Clippers, Trimmers, Blades, Shears, and Accessories at Osterstyle.com Professional Barber, 4 pages, Available online at least as early as Apr. 29, 2015 http://www.osterstyle.com/clippers/#prefn1=osyProfessional&prefv1=barber.
Web Article, Shop Clippers, Trimmers, Blades, Shears, and Accessories at Osterstyle.com, 4 pages, Available online at least as early as Apr. 29, 2015 http://www.osterstyle.com/clippers/.
Web Article, The Ultimate Guide to Hair Clipper Sizes, Buzzcut Guide,4 pages, Available online at least as early as Apr. 29, 2015 http://www.buzzcutguide.com/hair-clipper-sizes/.
Web Article,Regalo II, Barber Chair, BB-8960W / BB-8950W, www.takarabelmont.com, Available online at least as early as Apr. 29, 2015.

* cited by examiner

VERSATILE ACCESSORY HOLDER FOR A BARBER CHAIR

BACKGROUND OF THE INVENTION

Field of the Invention

This invention relates to a versatile accessory holder for a barber chair. In particular, the invention relates to a plate configured to be adapted to attach a tray to hang at least one compartment for accessories to any one of a plurality of barber chairs.

Background

Hair styling can involve the use of many tools, including scissors, clippers, clipper guides or guards, clipper blades, razors, combs, brushes, and creams. Different hair types, different skin sensitivities, or different customer preferences as to hair styles may require the use of different tools or even different sizes or gauges of the same tool. Also, typical hair styles require different lengths for different areas of the scalp: shorter on the sides, longer on the top, for example. It is known to use both scissors and clippers for many haircuts or hair styling operations. When clippers are used, it is known to utilize different clipper guards or guides, guide combs, or different blades altogether. Clipper manufacturers such as OSTER® or WAHL® provide different standard sizes of these tools for given hair lengths.

Barbers may generally use clippers with exchangeable blades, such as those offered by OSTER®. In those systems, the clipper blades are exchangeable corresponding to different lengths of hair remaining once used. For example when an OSTER® Blade Size 1 blade is placed on the clipper, hair having a length of 3/32" would remain. When an OSTER® Blade Size 1A is placed on the clipper, hair having a length of 1/8" would remain. In contrast, under the WAHL® system used by many stylist professionals, the clipper blades remain static and, instead, blade guides or guards are switched out based on the length of remaining hair desired. For example, when a WAHL® "number 1" guard is placed on the clipper, hair having a length of 1/8" would remain. When a WAHL® "number 5" guard is utilized on the clipper, hair having a length of 5/8" would remain. In each of these systems, by utilizing the different exchangeable blades or guards in different areas of the client's scalp, a barber or stylist may create and produce desired haircut.

Also, it is known that many stylists and beauty operators prefer to utilize even more blades throughout the day. A blade, sometimes referred to as a blade set is known to include the cutting blades and guide blades, as disclosed in the currently pending U.S. patent application Ser. No. 14/099,631 by Morono Hodge, entitled "Apparatus and Method for Customly Calibrating a Cutting Blade Set for a Hair Clipper" filed Dec. 6, 2013, incorporated herein in its entirety. That patent application describes a novel apparatus that allows a user to customly set a distance between the cutting blades and guide blades of any commercially available set of hair clippers. In any given day, a barber may need to utilize a dozen or so blades or cutting guards. Having to stop, go to the barber station, and switch blades or cutting guards on the clipper wastes valuable time and is inconvenient. Therefore, it would be desirable to provide a way to allow an operator to easily reach several blades or cutting guards throughout a haircut and throughout the day.

During the haircutting operation, therefore, it may be necessary to change blades or cutting guards multiple times. Further, it is often desirable to change entire clippers, or sets of clipper blades during a given haircut, or for cutting hair of multiple clients. It further is often desirable to change other tools during a haircut, such as barber combs. It is known that there are different types of barber combs, such as the barber comb disclosed in U.S. Pat. No. 8,800,572 to Morono Hodge, entitled "Fixed Point Barber Comb and Methods of Use," filed on Feb. 19, 2013 and issued Aug. 12, 2014, incorporated herein in its entirety.

One specific challenge to many stylists and barbers is the ease of exchanging barber tools while the client is in the barber chair or styling chair. For example, for a single customer, a barber may want to use both a clipper blade or cutting guard that provides a sensitive cut for facial areas and also a clipper blade or cutting guard that provides a smoother cut for scalp areas. Similarly, for a single customer, a barber may want to use both a clipper blade or cutting guard that provides a close cut for sideburns and also a clipper blade or cutting guard that leaves slightly longer hair for a given area of the scalp, and longer hair in another area of the scalp. In order to use two different types of clipper blades or cutting guards, a barber would need to store those blades or cutting guards on a counter or in a drawer and step away from his or her customer to exchange the appropriate clipper blades or cutting guards. Such an action may be time intensive and may appear disorganized to the customer. This problem becomes even greater should the barber need to use three or more clipper blades or cutting guards on a single customer. Therefore, it is desirable to provide a chair tray attachment plate for stylist or barber tools so that the barber may access the clipper blades or cutting guards from the back of the chair rather than step away to change between tools.

Further, it is known that there are a plurality of barber chair types. For purposes of the present discussion, these types may generally be categorized by the type of headrest attachment that each employs. Some barber chairs, such as those provided by TAKARA BELMONT® under the name Elegance use a single tongue opening in the chair back to attach a headrest utilizing an appendage such as a tongue, the headrest tongue being insertable into the opening in the chair back. Other barber chairs may utilize two pin appendages on the headrest adapted to be inserted into two openings in the top of the chair back. It is known to those in the art that different chairs may have the openings at different locations on the chair back but that the matching headrest would feature pin appendages at the matching location on the headrest. For instance, chairs by Mingjian Beauty Hairdressing Articles Firm marketed under the model number M121 have openings and appendages spaced in one configuration, while some antique chairs by KOKEN® have openings and pins spaced in a second configuration.

It is desirable to provide a chair tray attachment plate that is adaptable to fit multiple types of barber chairs, regardless of appendage, such as pin or tongue, positioning. Moreover, although a barber chair is used as illustrative, one of skill in the art would realize that this disclosure also applies to styling chairs and applicant is using those terms interchangeably, as would one of ordinary skill in the art. Therefore, references to barber chairs also include styling chairs.

Several attempts at providing a chair tray for stylist or barber tools are known. For example, the approach of Fowler described in U.S. Pat. No. 3,044,828 utilizes a tray attachment to the back of a barber chair. Fowler's attachment is secured utilizing a screw-down mechanism on the back of the chair, and the attachment mechanism also extends to the front of the chair where it may interfere with the customer's seating position or comfort. Alternatively, U.S. Pat. No. 3,235,305 to Dlouhy et al. describes a sterilizer tray that is built into the back panel of a barber chair and which would not be compatible with existing barber chairs that do not have a recess in the chair back. U.S. Pat. No. 3,245,716 to Danner describes a hairdresser's chair tray attachment that has a back-mounting mechanism that is not conducive to maintaining compatibility with a headrest. U.S. Pat. No. 4,136,908 to Crayne discloses a barber chair accessory mount that extends from the piston portion of a barber chair and, thus, may not be compatible with all types of barber chairs, such as non-hydraulic barber chairs. U.S. Pat. No. 5,887,940 to Anderson et al. discloses a chair attached tray, but the tray of Anderson is attached to the armrest rather than the back of the chair, which may be less convenient for stylists or barbers as compared to a backrest tray. U.S. Patent Application Publication No. 2011/0248531 to Powell discloses a mountable salon chair tray whose mounting mechanism suffers from the same pitfalls as Fowler's.

In each of these approaches, either the customer's comfort and/or seating position is potentially compromised or the apparatus is not adapted to work with a plurality of barber chair types. None describe a versatile accessory holder to hold accessories, such as clipper blades, that could be utilized with multiple barber chair types.

For the foregoing reasons, there is a need for a versatile accessory holder adapted to fit a plurality of types of barber chairs or styling chairs. It is further desirable that the attachment mechanism be simple to install and capable of holding a plurality of barber or stylist tools, such as clipper blades.

SUMMARY OF THE INVENTION

In some aspects, a versatile accessory holder for a barber chair where a headrest of the chair having one or more appendages adapted to be inserted into at least one opening in a chair back is described. The versatile accessory holder may have an attachment plate having a plurality of slots and an attachment plate tray coupled to the attachment plate. The attachment plate tray may have one or more compartments adapted to receive one or more accessories such as a plurality of clipper blades. One or more of the plurality of slots on the attachment plate are adapted to receive the one or more appendages of the chair to selectively secure the attachment plate to the at least one opening in the chair back, thereby facilitating the exchange of accessories stored in one or more of the compartments.

In some embodiments one or more walls of the attachment plate tray is coupled to a strip adapted to fasten a magnet to the attachment plate tray. Further, the strip may be made of metal. Still further, the metal of the strip may be stainless steel.

In some embodiments, the bottom of the one or more compartments of the attachment plate tray has one or more openings. Further, the bottom of the one or more compartments of the attachment plate tray may have one or more compartment stops. Still further, the one or more compartment stops may comprise the entire bottom of the one or more compartments of the attachment plate tray.

In some embodiments, the plurality of slots includes one or more slots adapted to receive one or more appendages in the form of a tongue. Further, the plurality of slots may include two or more other slots adapted to receive two or more appendages in the form of a first set of pins. Still further, the plurality of slots may comprise two or more other slots adapted to receive two or more appendages in the form of a second set of pins.

In some embodiments, the one or more of the plurality of slots on the attachment plate are circular. In some embodiments, the attachment plate tray is rectangular. In some embodiments, the one or more compartments of the attachment plate tray are rectangular. In other embodiments, the one or more compartments of the attachment plate tray are square.

Also described is a versatile accessory holder for a barber chair having one or more appendages adapted to be inserted into at least one opening in a chair back. The versatile accessory holder comprises an attachment plate having a plurality of slots and an attachment plate tray coupled to the attachment plate. The attachment plate tray may have one or more compartments adapted to receive one or more accessories such as a plurality of clipper blades coupled to the attachment plate. The versatile accessory holder also comprises a means for attaching the attachment plate to the at least one opening in the chair back, thus facilitating the exchange of accessories stored in one or more of the compartments.

In some embodiments, the attachment plate comprises a slot adapted to receive one appendage in the form of a tongue of the one or more appendages, a pair of slots adapted to receive a pair of appendages in the form of a first pair of pins of the one or more appendages, and a second pair of slots adapted to receive a pair of appendages in the form of a second pair of pins of the one or more appendages.

Also described is a method of attaching an attachment plate tray to a barber chair having a headrest with one or more appendages coupled to one or more openings in a chair back. The method comprises removing the headrest from the barber chair by withdrawing the one or more appendages from the one or more openings in the chair back, inserting the one or more appendages through one or more slots of a plurality of slots on an attachment plate, the attachment plate having the attachment plate tray coupled to the attachment plate, the attachment plate tray having one or more compartments adapted to receive one or more accessories such as a plurality of clipper blades, wherein the plurality of slots comprises a slot adapted to receive an appendage in the form of a tongue and a separate pair of slots adapted to receive a pair of appendages in the form of a first pair of pins, and inserting the one or more appendages into the one or more openings in the chair back.

DESCRIPTION OF ILLUSTRATIVE EMBODIMENTS

The invention relates to a versatile accessory holder adapted to attach accessories, such as stylist or barber tools, to one of a plurality of barber chair types. In some embodiments, the versatile accessory holder includes a plurality of slots, the slots being adapted to receive one or more appendages to selectively secure a tray to the chair. In one embodiment, the appendage is a tongue. In other embodiments, the appendages are pins.

In some embodiments, a tray may be coupled to the versatile accessory holder to store stylist and barber tools. In some embodiments, this tray is adapted to receive a plurality of accessories, such as clipper blades, cutting guards, or other styling tools. For example, the tray may be divided into a plurality of compartments to receive a plurality of clipper blades. In this way, the present invention advantageously allows a barber or stylist to quickly access a plurality of clipper blades from the back of the barber chair where he or she is working. Thus, cost and space is reduced compared to utilizing storage away from the chair or work area, and the speed of the haircut may be increased.

In some embodiments, the compartments in the tray may further be partially open at the bottom with stops to hold the contents in place. This is advantageous when storing clipper blades in the compartments, for example, to allow hair from the clipper blades to fall through the open portions of the compartments onto the floor. Therefore, the compartments would require less frequent cleaning and the excess hair may be swept from the floor when the barber or stylist is cleaning the floor following a haircut. Thus, cost and space is reduced compared to a system in which the tray must be cleaned on a more frequent basis.

One of ordinary skill in the art would further recognize that the versatile accessory holder could be adapted to attach other types of trays or storage, including circular trays, square trays, cylindrical trays, and other tray types. Further aspects and advantages of the various embodiments of the invention are apparent to one of skill in the art having the benefit of this disclosure from consideration of the following description and drawings.

Figure 1C:
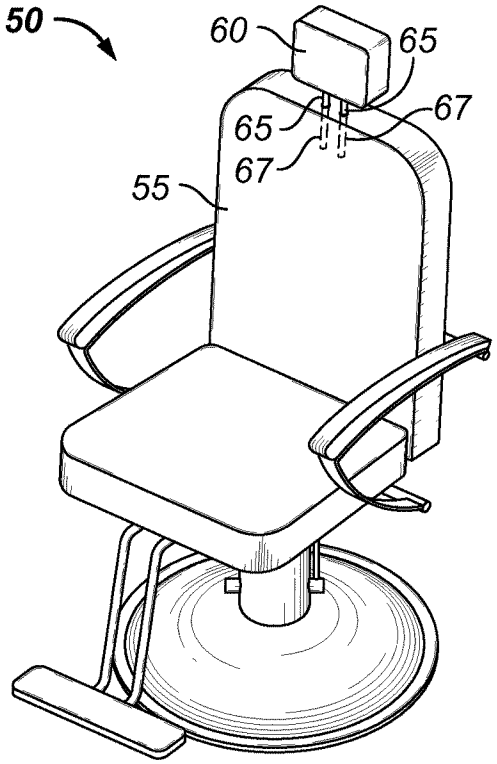
FIG. 1C (Prior Art)
FIG. 1C shows a prior art barber chair utilizing appendages in the form of spaced pins to connect the headrest to the back of the barber chair.
Figure 1B:
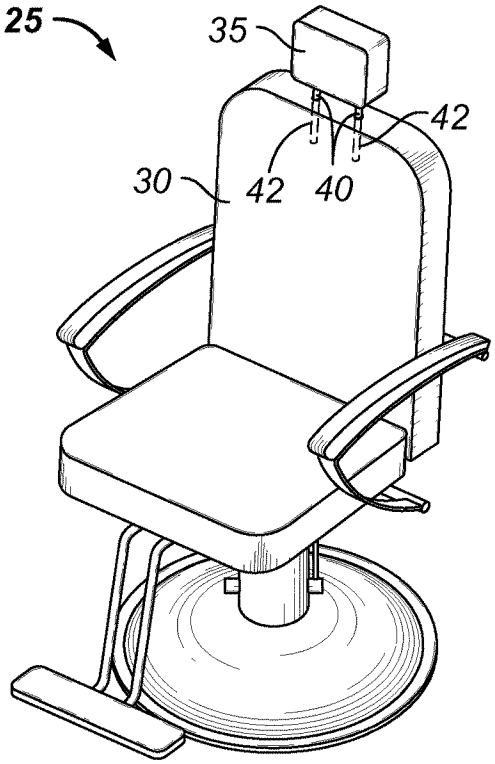
FIG. 1B (Prior Art)
FIG. 1B shows a prior art barber chair utilizing appendages in the form of spaced pins to connect the headrest to the back of the barber chair.
Figure 1A:
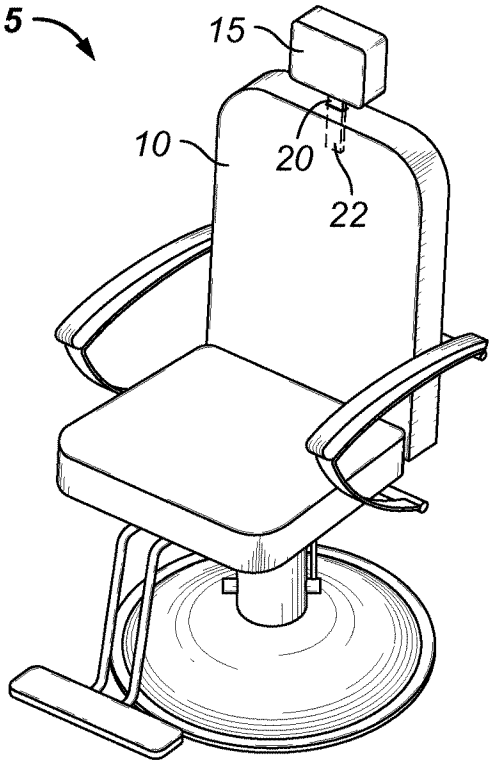
FIG. 1A (Prior Art)
FIG. 1A shows a prior art barber chair utilizing a tongue appendage to connect the headrest to the back of the barber chair.

Referring to FIGS. 1A, 1B, and 1C, three prior art barber chairs are shown. A difference between these three barber chairs is the manner of coupling a headrest to the barber chair. In each prior art example from FIGS. 1A, 1B, and 1C, the headrest is coupled to the top of the back of the chair. For example, in FIG. 1A, the headrest 15 is coupled to the top of the chair back 10 of barber chair 5 utilizing an appendage, such as a tongue 20, which is inserted into an opening 22 at the top of the chair back 10. In FIG. 1B, the headrest 35 is coupled to the top of the chair back 30 of barber chair 25 utilizing appendages in the form of pins 40 which are inserted into openings 42 in the top of the chair back 30. In FIG. 1C, the headrest 60 is coupled to the top of the chair back 55 of barber chair 50 utilizing appendages in the form of pins 65 which are inserted into openings 67 in the top of the chair back 55.

Figure 2A:
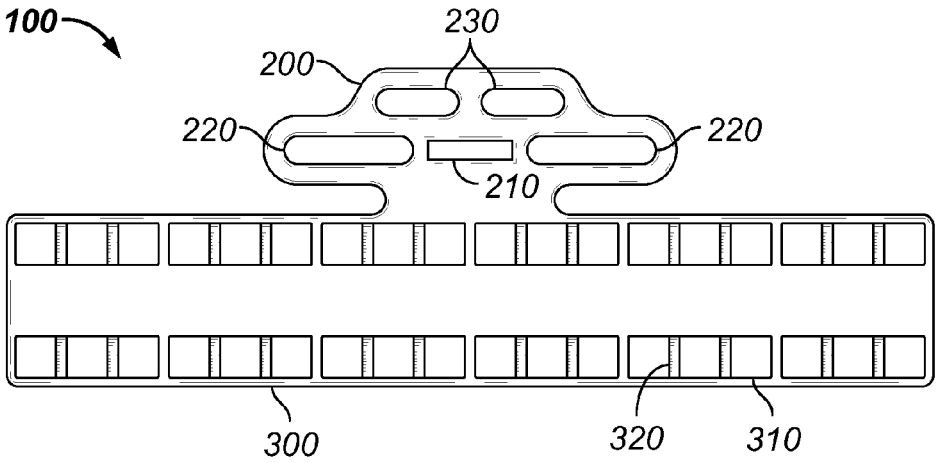
FIG. 2A shows a top view of one embodiment of the present invention.
Figure 2B:
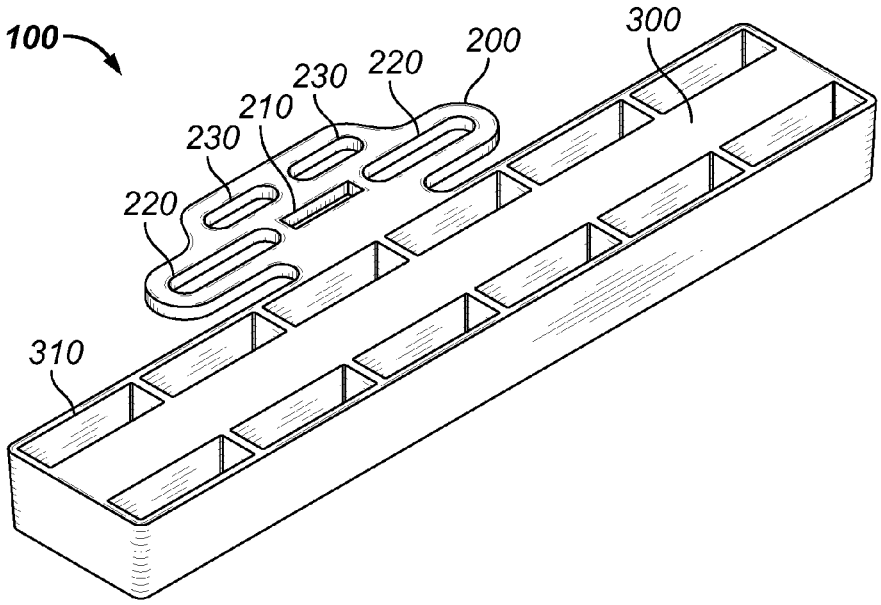
FIG. 2B shows a perspective view of the embodiment of FIG. 2A.

Referring to FIGS. 2A and 2B, one embodiment of the present invention is shown. Versatile accessory holder 100 is comprised from attachment plate 200 and attachment plate tray 300. Attachment plate 200 includes apertures in the form of tongue slot 210, a first set of pin slots 220, and a second set of pin slots 230. By having each of these different types of slots, attachment plate 200 is adaptable to attach to any one of a plurality of different types of barber chairs that have different types of openings to accept different types of appendages, such as a tongue or sets of pins, for attaching a headrest. However, one of ordinary skill in the art would recognize that attachment plate 200 need not contain each type of slot and that a subset of slots would be sufficient for versatile accessory holder 100 to be compatible with at least a subset of barber chairs. Additionally, as would be realized by one of ordinary skill in the art having the benefit of this disclosure, the slots in the attachment plate could take on any type of shape necessary to fit different types of appendages. Further, a means for attaching the versatile accessory holder to the chair back is described. For instance, the means of attaching attachment plate 200 to the back of a barber chair include the slots that accept one or more appendages, including a tongue or pins, as described herein.

Attachment plate tray 300 includes a plurality of compartments 310. Although this embodiment includes twelve compartments 310, attachment plate tray may 300 may include any number of compartments 310. Compartments 310 are shown to be at least partially open at the bottom in this embodiment to allow hair to fall through the compartments. Compartments 310 further includes compartment stops 320 to prevent contents from falling through a compartment 310 when those contents are placed in the slot. One of ordinary skill in the art would recognize that instead of two compartment stops 320 for each compartment 310, any number of compartment stops 320 may be used, including one, three, four or more compartment stops 320. Alternatively, compartments 310 may have no compartment stops and contents, e.g., clipper blades, could be held in place by the top of the contents, e.g., the top of the clipper blades, being wider than compartments 310.

Versatile accessory holder 100 may be made from any suitable material, including plastic, metal, silicone, glass, stone, wood, or the like. Further, attachment plate 200 may be made from a different material than attachment plate tray 300 provided that attachment plate 200 and attachment plate tray 300 are otherwise coupled. Moreover, each of attachment plate 200 and attachment plate tray 300 may be comprised of more than one material.

Figure 2C:
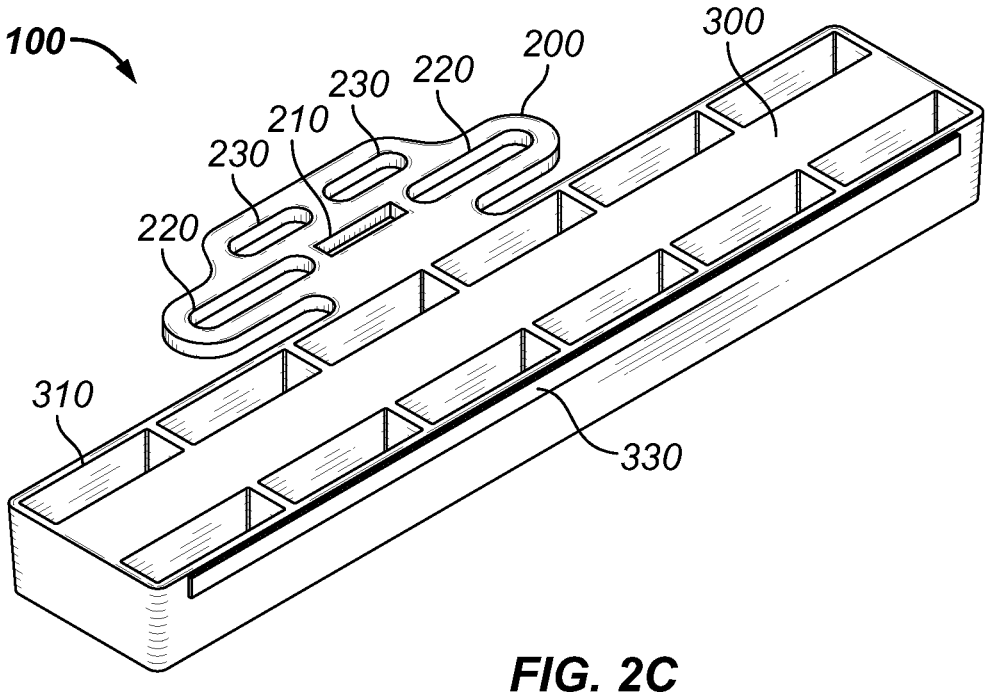
FIG. 2C shows a perspective view of the embodiment of FIG. 2A incorporating strip 330.

Referring to FIG. 2C, in one embodiment of the present invention, strip 330 is coupled to the outer wall of attachment plate tray 300. Strip 330 may be coupled to the outer wall of attachment plate tray 300 by utilizing glue, welding, or the strip may be built into the outer wall of attachment plate tray 300. Strip 330 may be made from any material to which a magnet can attach magnetically, such as certain types of stainless steel. Strip 330 may then be used to fasten magnetic objects, such as certain clipper blades, in place without the need to place them in one of compartments 310, as would be realized by one of ordinary skill in the art having the benefit of this disclosure. Although in this embodiment, strip 330 occupies only a small area at the top of the outer wall of attachment plate tray 300, in other embodiments, strip 330 may be any size and placed in any position on the outer wall of attachment plate 300, and it may even comprise the entire outer wall of attachment plate 300.

Figure 3A:
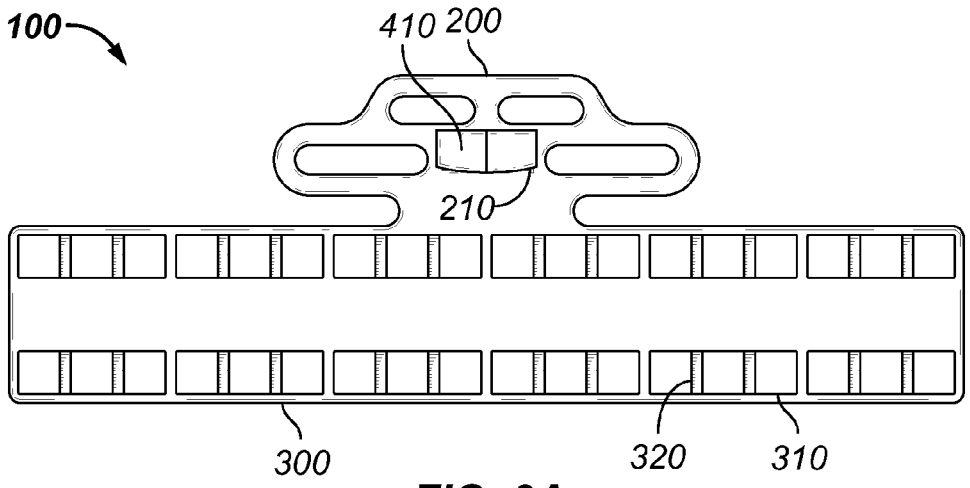
FIG. 3A shows a top view of one embodiment of the present invention utilizing a tongue for use with barber chairs with a back having a tongue opening.
Figure 3B:
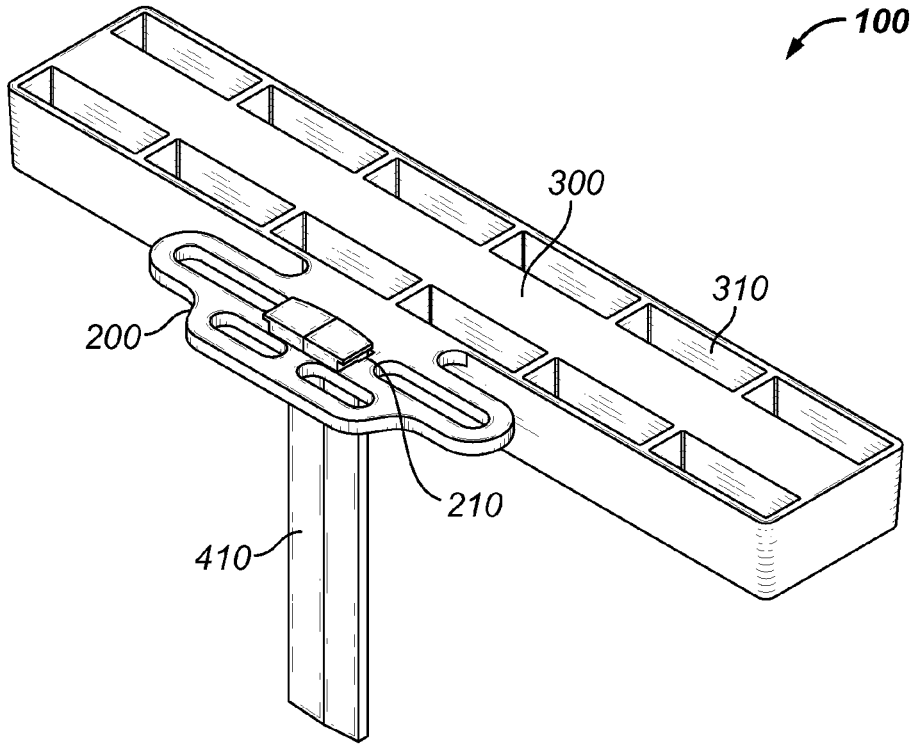
FIG. 3B shows a perspective view of the embodiment of FIG. 3A.
Figure 3C:
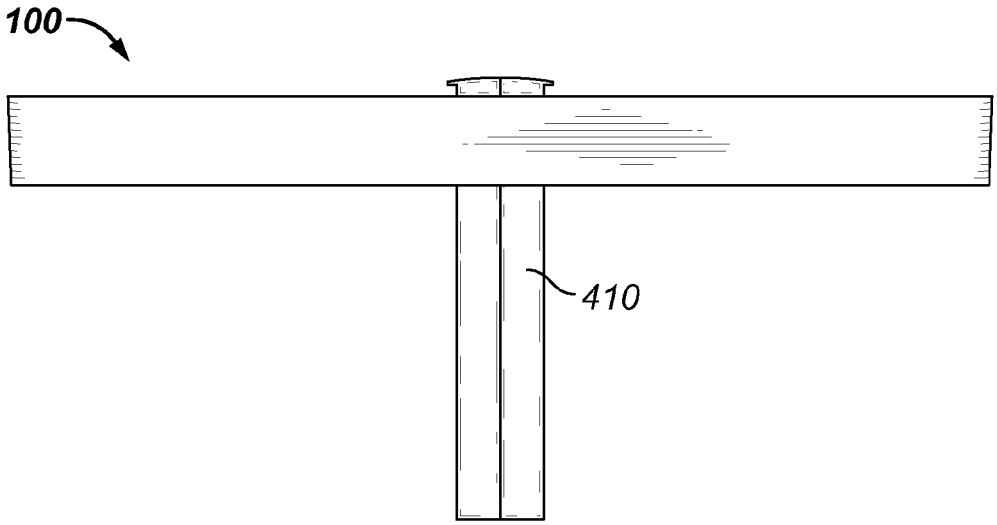
FIG. 3C shows the embodiment of FIG. 3A from a side view, having an appendage in the form of a tongue attached.
Figure 3D:
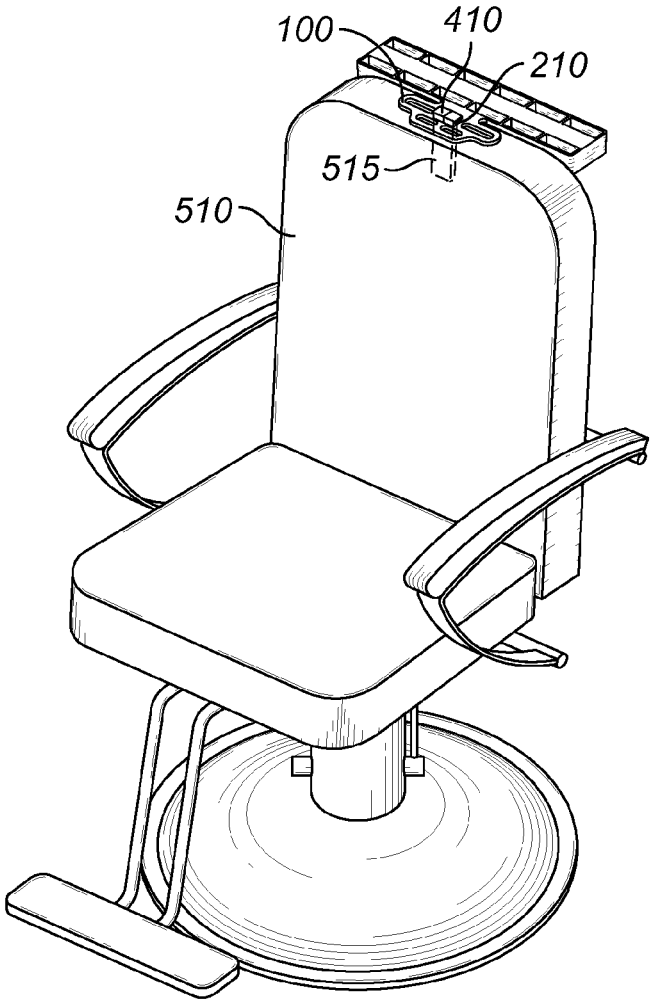
FIG. 3D shows the embodiment of FIG. 3A with the attachment plate mounted onto a barber chair utilizing the appendage in the form of a tongue inserted into openings in the chair back.
Figure 3E:
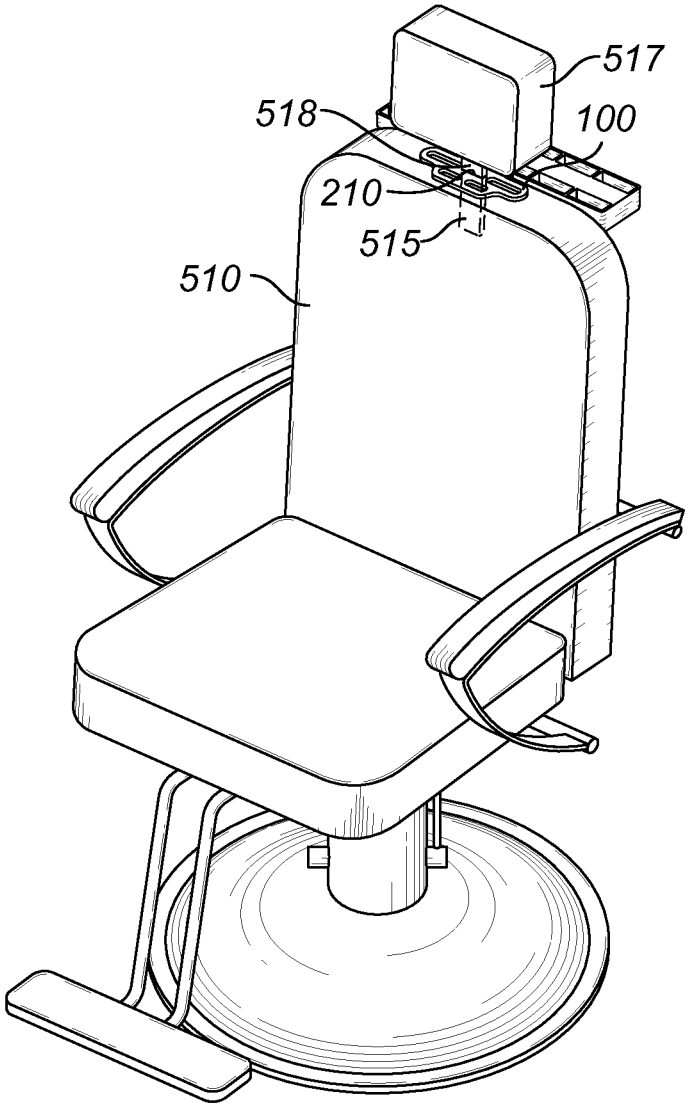
FIG. 3E shows the embodiment of FIG. 3A with the attachment plate mounted onto a barber chair utilizing a headrest with an appendage in the form of a tongue inserted into openings in the chair back.

Referring to FIGS. 3A, 3B, and 3C, an embodiment of the present invention utilizing a tongue is shown. The tongue slot 210 of attachment plate 200 is adapted to receive tongue 410. FIG. 3D further shows this embodiment as attached to the back 510 of a barber chair with a tongue opening 515. Tongue 410 first fits through tongue slot 210 of attachment plate 200 and then fits directly into the tongue opening 515 of the back 510 of the barber chair. The top portion of tongue 410 may be larger than tongue slot 210 so that the top of tongue 410 holds versatile accessory holder 100 in place. Alternatively, a tongue may be coupled to a headrest so that when inserted, the headrest secures versatile accessory holder 100 using a tongue, as would be realized by one of ordinary skill in the art having the benefit of this disclosure. This is shown in FIG. 3E in which the versatile accessory holder 100 is secured to the back 510 of a barber chair with a tongue opening 515 by fitting the tongue 518 of headrest 517 through both the tongue slot 210 of the attachment plate 200 and the tongue opening 515 of the back 510 of the barber chair.

Figure 4A:
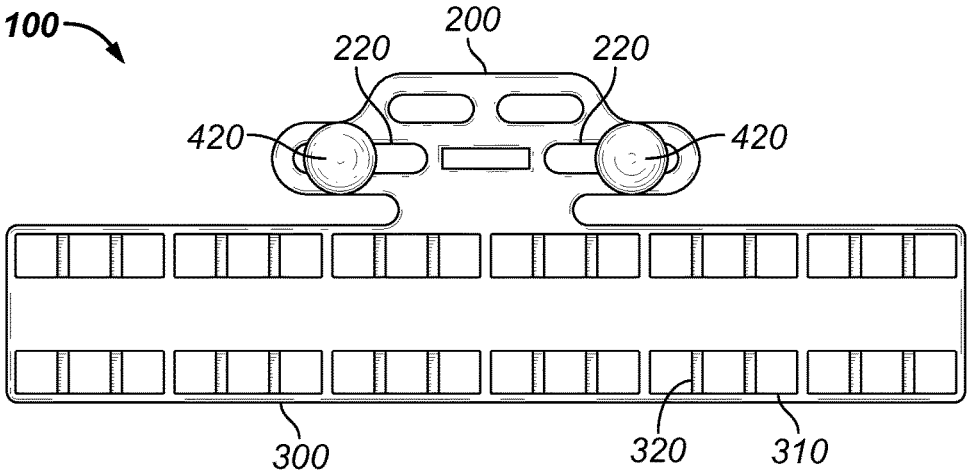
FIG. 4A shows a top view of one embodiment of the present invention for use with barber chairs with a back having a first set of pin openings.
Figure 4B:
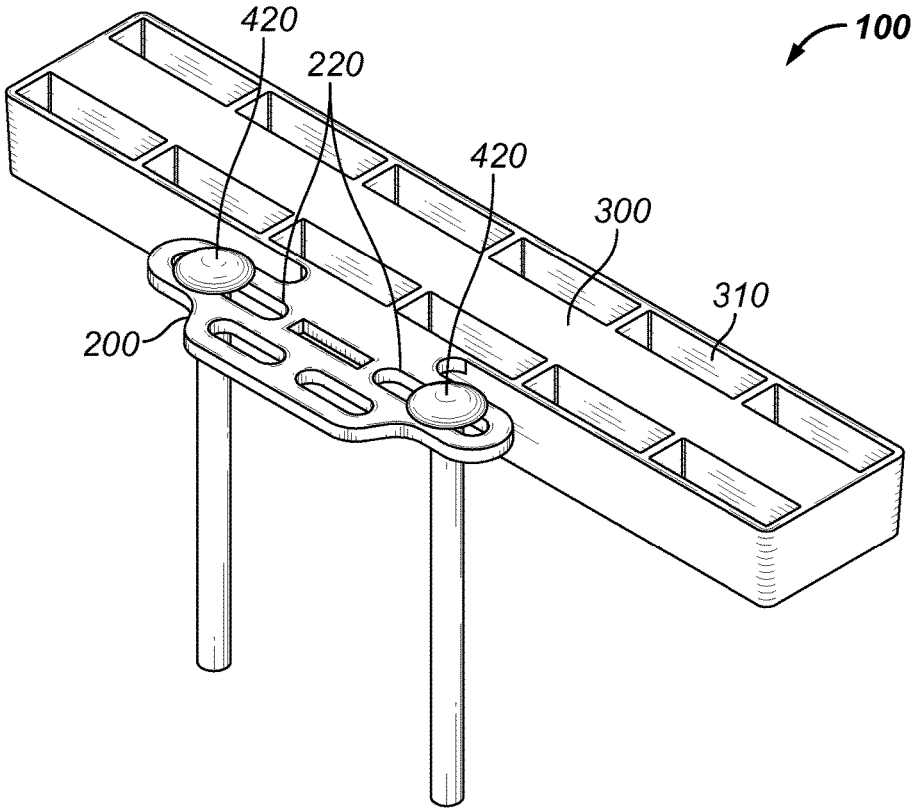
FIG. 4B shows a perspective view of the embodiment of FIG. 4A.
Figure 4C:
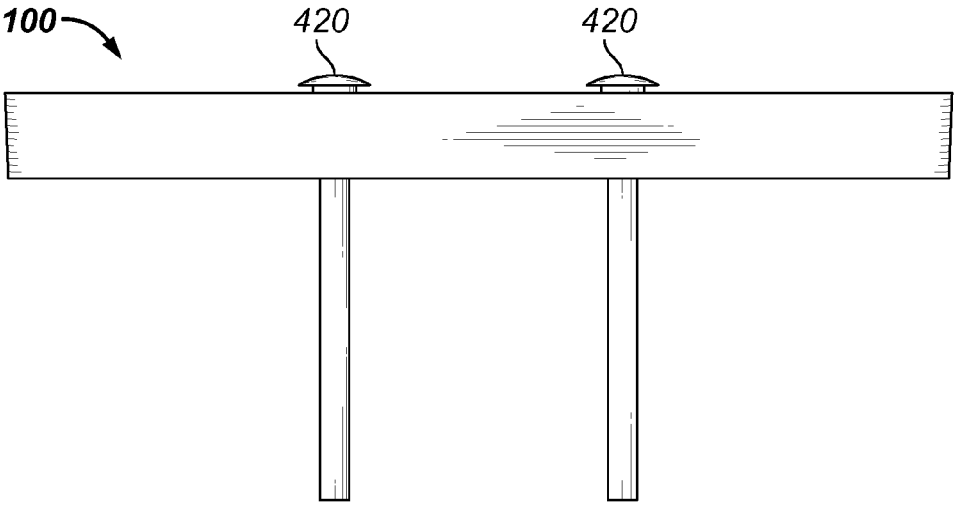
FIG. 4C shows the embodiment of FIG. 4A from a side view, having appendages in the form of a first set of pins attached.
Figure 4D:
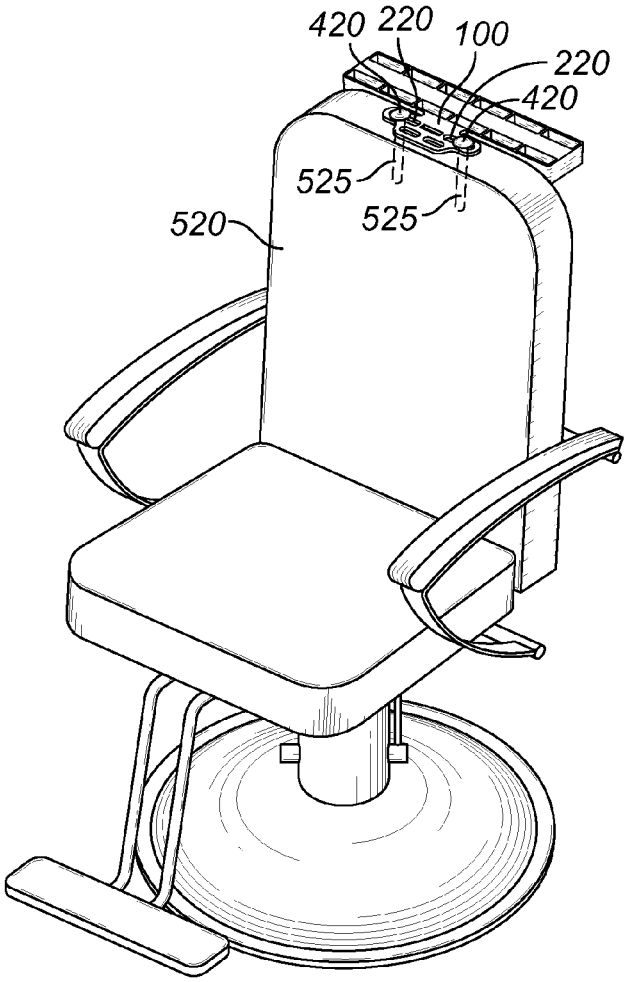
FIG. 4D shows the embodiment of FIG. 4A with the attachment plate mounted onto a barber chair utilizing appendages in the form of a first set of pins inserted into openings in the chair back.
Figure 4E:
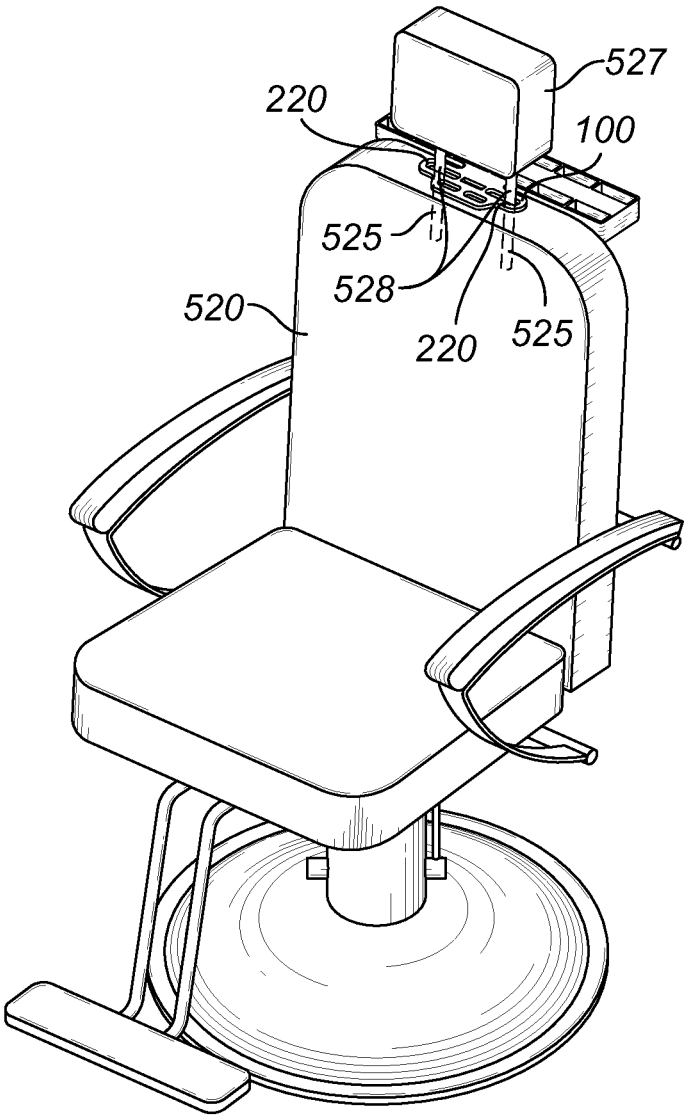
FIG. 4E shows the embodiment of FIG. 4A with the attachment plate mounted onto a barber chair utilizing a headrest with appendages in the form of a pins inserted into openings in the chair back.

Referring to FIGS. 4A, 4B, and 4C, an embodiment of the present invention utilizing a first set of pins is shown. Each of the first set of pins 420 is received through one of first set of pin slots 220 of attachment plate 200. FIG. 4D further shows this embodiment as attached to the back 520 of a barber chair with a first set of pin openings 525. The first set of pins 420 first fit through first set of pin slots 220 of attachment plate 200 and then fit directly into the first set of pin openings 525 of the back 520 of the barber chair. The top portion of each of the first set of pins 420 may be larger than first set of pin slots 220 so that the top of each of the first set of pins 420 hold versatile accessory holder 100 in place. Alternatively, the first set of pins may be coupled to a headrest so that when inserted, the headrest secures versatile accessory holder 100 using the first set of pins, as would be realized by one of ordinary skill in the art having the benefit of this disclosure. This is shown in FIG. 4E in which the versatile accessory holder 100 is secured to the back 520 of a barber chair with a first set of pin openings 525 by fitting a first set of pins 528 of headrest 527 through both the first set of pin slots 220 of the attachment plate 200 and the first set of pin openings 525 of the back 520 of the barber chair.

Figure 5A:
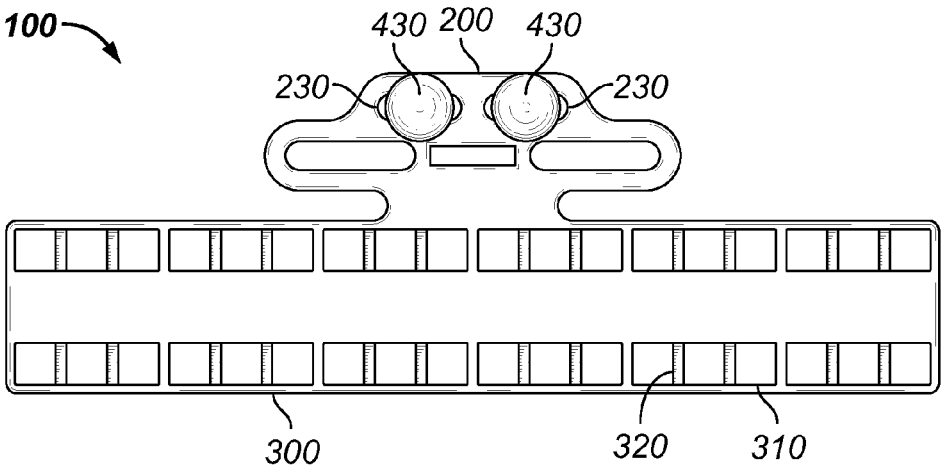
FIG. 5A shows a top view of one embodiment of the present invention for use with barber chairs with a back having a second set of pin openings with different spacing than the pin openings of FIG. 4A.
Figure 5B:
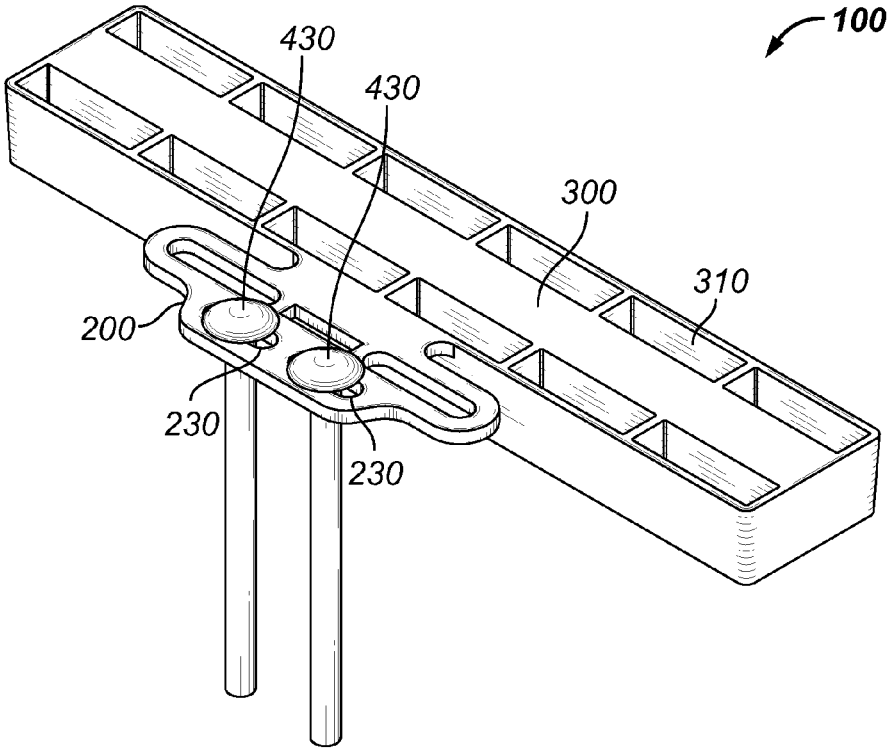
FIG. 5B shows a perspective view of the embodiment of FIG. 5A.
Figure 5C:
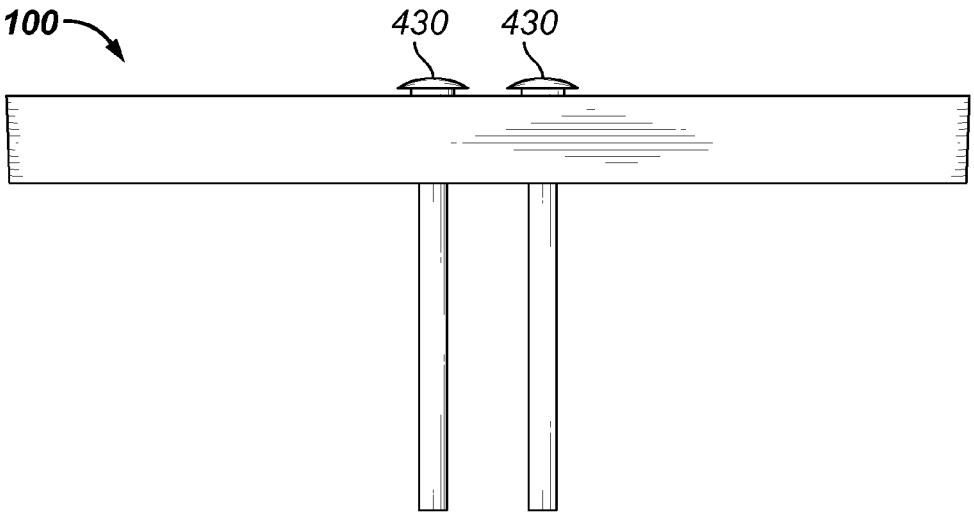
FIG. 5C shows the embodiment of FIG. 5A from a side view, having appendages in the form of a second set of pins attached.
Figure 5D:
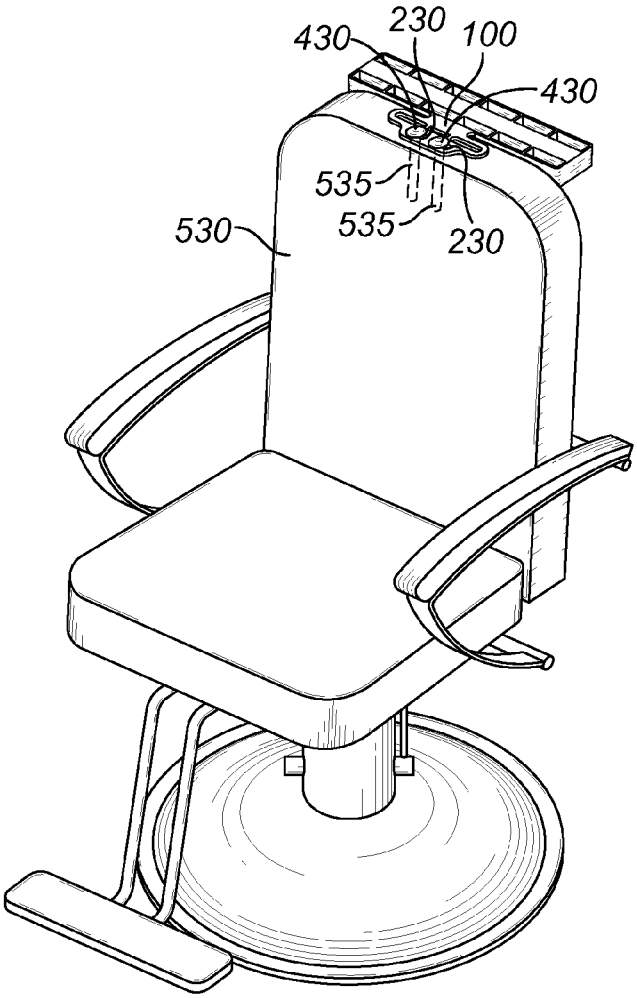
FIG. 5D shows the embodiment of FIG. 5A with the attachment plate mounted onto a barber chair utilizing appendages in the form of a second set of pins inserted into openings in the chair back.
Figure 5E:
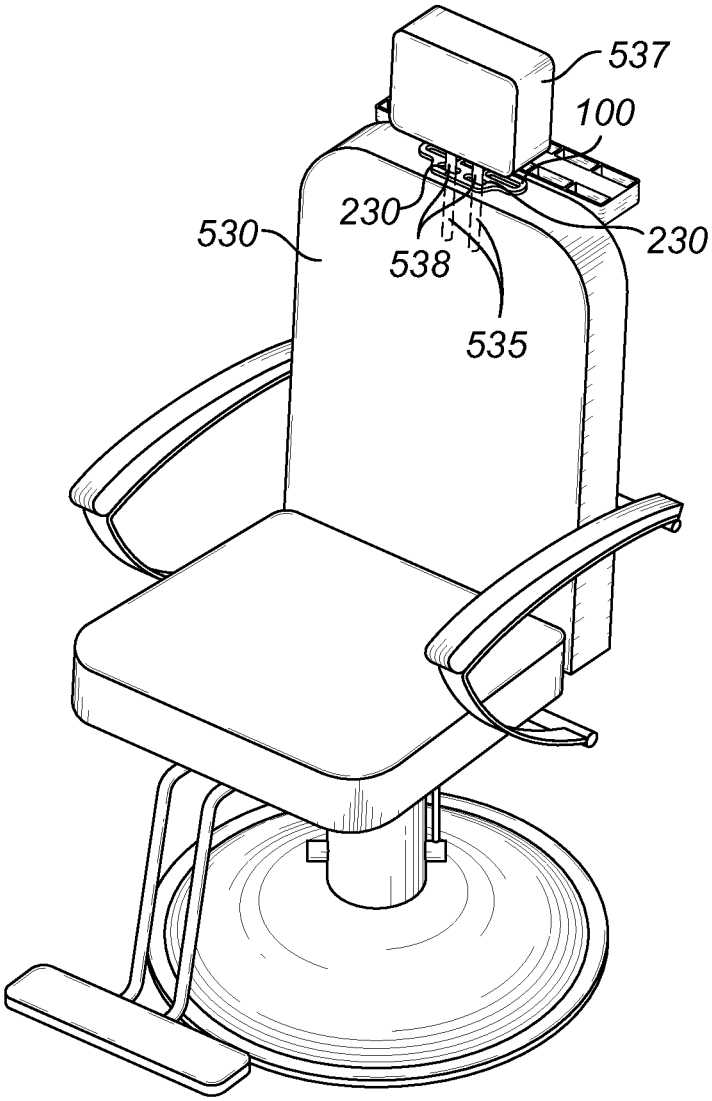
FIG. 5E shows the embodiment of FIG. 5A with the attachment plate mounted onto a barber chair utilizing a head rest with appendages in the form of a pins inserted into openings in the chair back.

Referring to FIGS. 5A, 5B, and 5C, an embodiment of the present invention utilizing a second set of pins is shown. The second set of pins are closer together than the first set of pins, as shown, but this is not necessary. Each of the second set of pin slots 230 of the attachment plate 200 is adapted to receive each of the second set of pins 430. FIG. 5D further shows this embodiment as attached to the back 530 of a barber chair with a second set of pin openings 535. Each of the second set of pins 430 first fits through the second set of pin slots 230 of attachment plate 200 and then fits directly into the second set of pin openings 535 of the back 530 of the barber chair. The top portion of each of the second set of pins 430 may be larger than each of the second set of pin slots 230 so that the top of each of the second set of pins 430 hold versatile accessory holder 100 in place. Alternatively, a second set of pins may be coupled to a headrest so that when inserted, the headrest secures versatile accessory holder 100 using the second set of pins, as would be realized by one of ordinary skill in the art having the benefit of this disclosure. This is shown in FIG. 5E in which the versatile accessory holder 100 is secured to the back 530 of a barber chair with a second set of pin openings 535 by fitting the second set of pins 538 of headrest 537 through both the second set of pin slots 230 of the attachment plate 200 and the second set of pin openings 535 of the back 530 of the barber chair.

In operation, a barber would identify a chair on which he or she would like to place an attachment plate tray 300. The barber would then remove the appendages, including the headrest, if any, from the back of the barber chair. Once the barber chair has no appendages, e.g., tongue 410, first set of pins 420, or second set of pins 420, in the chair back, the barber would identify which type of openings the back of the barber chair utilizes to accept one or more appendages, including the headrest. Once the openings are identified, the barber would selectively place one or more slots 210, 220, or 230 of the attachment plate 200 over the corresponding type of opening 515, 525, 535 in the back of the barber chair, and the barber would then place an appropriate attachment appendage through the now lined-up corresponding attachment plate 200 slot or slots 210, 220, or 230 and the opening or openings 515, 525, or 535 in the back of the barber chair. For example, if the back of the barber chair includes a tongue opening 515, then the barber would place the tongue slot 210 of the attachment plate 200 over the tongue opening 515 of the back of the barber chair. The barber would then place a tongue 410 or a headrest 517 with a tongue 518 through tongue slot 210 of attachment plate 200 and the tongue opening 515 of the back of the barber chair. The tongue may be selectively coupled to a headrest, or the top portion of the tongue may be slightly larger than tongue slot 210 to secure attachment plate 200 into place.

Once the attachment plate 200 is secured in place, the attachment plate tray 300 should be directly behind the barber chair. A barber could then place one or more accessories, such as clipper blades, into the one or more compartments 310 or onto the strip 330 of the attachment plate tray 300 if the accessory is magnetic. During a haircut or style, the barber would then be able to readily access one or more of the tools from the attachment plate tray 300 on the back of the barber chair. If the barber desired to switch clipper blades for example, the barber would remove the current blade on the clipper, place that blade into an open compartment 310 of the attachment plate tray 300, and the barber could then select a different clipper blade for use from a different compartment 310 of attachment plate tray 300. The barber would then remove the desired clipper blade from a compartment 310 and install it on his clipper. In this way, the barber could readily exchange accessories without leaving his position behind the chair during the haircut, as would be realized by one of ordinary skill in the art having the benefit of this disclosure.

Although various embodiments have been shown and described, the invention is not so limited and will be understood to include all such modifications and variations as would be apparent to one of skilled in the art. For example, the versatile accessory holder 100 of the present invention could accommodate unconventional barber chairs that have a plurality of attachment mechanisms, such as barber chairs that receive both a first set of pins and a second set of pins or both pins and a tongue. In those instances, versatile accessory holder 100 could simultaneously receive pins and/or a tongue in the appropriate slots. Similarly, attachment plate 200 could include additional or alternative slots for compatibility with additional types of barber chairs.

The following table lists the description and the reference numbers as used herein and in the drawings attached hereto:

| Number | Name |
|---|---|
| 5 | Barber Chair with Tongue Attached Headrest |
| 10 | Back of Barber Chair with Tongue Attached Headrest |
| 15 | Headrest |
| 20 | Tongue |
| 22 | Tongue opening |
| 25 | Barber chair with First Set of Pins Attached Headrest |
| 30 | Back of Barber chair with First Set of Pins Attached Headrest |
| 35 | Headrest |
| 40 | First Set of Pins |
| 42 | First Set of Pin Openings |
| 50 | Barber chair with Second Set of Pins Attached Headrest |
| 55 | Back of Barber chair with Second Set of Pins Attached Headrest |
| 60 | Headrest |
| 65 | Second Set of Pins |
| 67 | Second Set of Pin Openings |
| 100 | Versatile Accessory Holder |
| 200 | Attachment Plate |
| 210 | Tongue Slot |
| 220 | First Set of Pin Slots |
| 230 | Second Set of Pin Slots |
| 300 | Attachment Plate Tray |
| 310 | Compartment |
| 320 | Compartment stop |
| 330 | Strip |
| 410 | Tongue |
| 420 | First Set of Pins |
| 430 | Second Set of Pins |
| 510 | Back of Barber Chair With Tongue Opening |
| 515 | Tongue Opening |
| 517 | Headrest |
| 518 | Tongue |
| 520 | Back of Barber Chair With a First Set of Pin Openings |
| 525 | First Set of Pin Openings |
| 527 | Headrest |
| 528 | First Set of Pins |
| 530 | Back of Barber Chair With a Second Set of Pin Openings |
| 535 | Second Set of Pin Openings |
| 537 | Headrest |
| 538 | Second Set of Pins |

What is claimed is:

1. A versatile accessory holder for a barber chair, a headrest of the chair having one or more appendages adapted to be inserted into at least one opening in a chair back, the versatile accessory holder comprising:

an attachment plate having a plurality of slots, and an attachment plate tray coupled to the attachment plate, the attachment plate tray having one or more compartments adapted to receive one or more accessories such as a plurality of clipper blades, wherein the plurality of slots on the attachment plate are adapted to receive the one or more appendages of the headrest to selectively secure the attachment plate to the chair back, wherein the plurality of slots comprises one slot adapted to receive one appendage in the form of a tongue, and two or more other slots adapted to receive two or more appendages in the form of a set of pins.

2. The versatile accessory holder of claim 1 wherein one or more walls of the attachment plate tray is coupled to a strip adapted to fasten a magnet to the attachment plate tray.

3. The versatile accessory holder of claim 2 wherein the strip is made of metal.

4. The versatile accessory holder of claim 3 wherein the strip is made of stainless steel.

5. The versatile accessory holder of claim 1 wherein a bottom of one or more of the one or more compartments of the attachment plate tray has one or more openings.

6. The versatile accessory holder of claim 5 wherein a bottom of one or more of the one or more compartments of the attachment plate tray has one or more compartment stops.

7. The versatile accessory holder of claim 6 further comprising wherein the one or more compartment stops comprises the entire bottom of the one or more compartments of the attachment plate tray.

8. The versatile accessory holder of claim 1 wherein one or more of the plurality of slots on the attachment plate are circular.

9. The versatile accessory holder of claim 1 wherein the attachment plate tray is rectangular.

10. The versatile accessory holder of claim 1 wherein the one or more compartments of the attachment plate tray are rectangular.

11. The versatile accessory holder of claim 1 wherein the one or more compartments of the attachment plate tray are square.

12. A versatile accessory holder for a barber chair, a headrest of the chair having one or more appendages adapted to be inserted into at least one opening in a chair back, the versatile accessory holder comprising:

an attachment plate, comprising:

a slot adapted to receive one appendage in the form of a tongue, a separate first pair of slots adapted to receive a pair of appendages in the form of a first pair of pins, and a separate second pair of slots adapted to receive a pair of appendages in the form of a second pair of pins;

an attachment plate tray coupled to the attachment plate, the attachment plate tray having one or more compartments adapted to receive one or more accessories such as a plurality of clipper blades; and means for attaching the attachment plate to the at least one opening in the chair back, thus facilitating the exchange of accessories stored in one or more of the compartments.

* * * * *